US006490867B2

(12) United States Patent
Braun et al.

(10) Patent No.: US 6,490,867 B2
(45) Date of Patent: Dec. 10, 2002

(54) METHOD OF OPERATING A BURNER AND BURNER CONFIGURATION

(75) Inventors: Gilbert Braun, Herzogenrath (DE); Eberhard Deuker, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/804,326

(22) Filed: Mar. 12, 2001

(65) Prior Publication Data

US 2001/0023578 A1 Sep. 27, 2001

Related U.S. Application Data

(63) Continuation of application No. PCT/DE99/02713, filed on Aug. 31, 1999.

(30) Foreign Application Priority Data

Sep. 10, 1998 (DE) ..... 198 41 424

(51) Int. Cl.[7] ..... F02C 7/26; F02C 9/26
(52) U.S. Cl. ..... 60/776; 60/39.281
(58) Field of Search ..... 60/39.281, 776

(56) References Cited

U.S. PATENT DOCUMENTS 4,472,936 A * 9/1984 Uchiyama et al. ..... 422/111
4,716,719 A 1/1988 Takahashi et al.
4,761,948 A * 8/1988 Sood et al. ..... 60/39.281
5,272,637 A 12/1993 Urushidani et al.
5,281,129 A * 1/1994 Urushidani et al. ..... 431/12
5,327,718 A * 7/1994 Iwata et al. ..... 60/39.27
5,357,741 A * 10/1994 Talabisco et al. ..... 60/39.3
6,199,366 B1 * 3/2001 Murata et al. ..... 60/734

FOREIGN PATENT DOCUMENTS

DE 196 27 857 * 1/1998
EP 0 432 570 A2 6/1991

* cited by examiner

*Primary Examiner*—Charles G. Freay
(74) *Attorney, Agent, or Firm*—Laurence A. Greenberg; Werner H. Stemer; Gregory L. Mayback

(57) ABSTRACT

A method of operating a burner, in particular, a burner of a gas turbine, and a burner configuration include supplying an adjustable burner with fuel through a supply line. The fuel quantity is set by an opening of a control element as a function of a selected output of the burner. A calorific value of the fuel is determined, and the degree of opening is calculated and directly set using the output and the calorific value, resulting in a variable output control that is operationally reliable with respect to perturbations. A controller is connected to the control element having a selectable opening for setting the fuel quantity. In the controller, the degree of opening can be determined as a function of the output, the type of the fuel, and a pressure loss in the fuel supply line, and a corresponding signal can be transmitted to the control element such that the degree of opening is set.

9 Claims, 1 Drawing Sheet

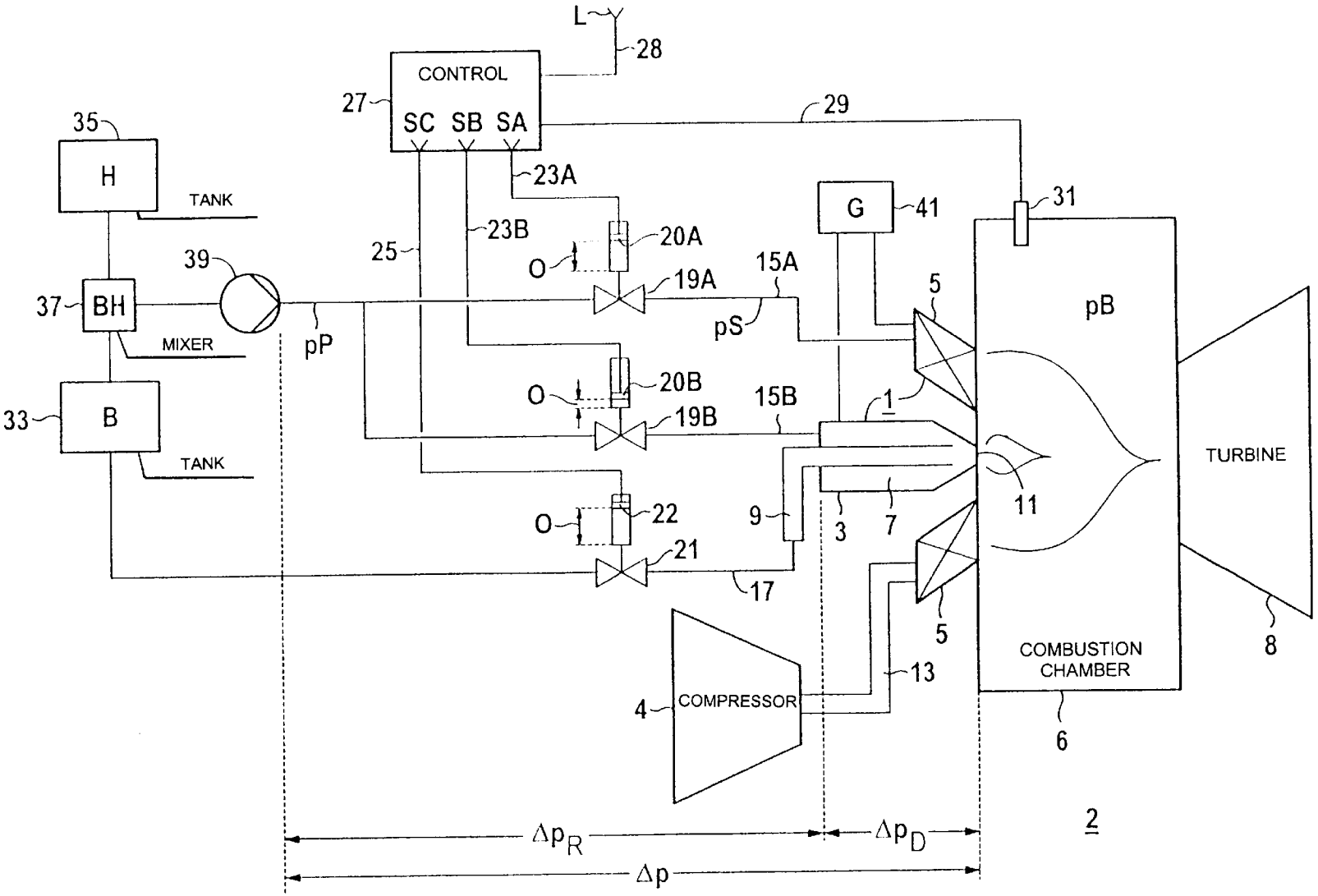
TURBINE
8
pB
COMBUSTION CHAMBER
6
2
31
11
5
5
41
G
1
7
3
13
29
15A
pS
15B
9
17
COMPRESSOR
4
20A
19A
20B
19B
22
21
28
L
23A
23B
CONTROL
SA
SB
SC
27
25
pP
39
TANK
MIXER
TANK
35
H
BH
37
B
33
$\Delta p_D$
$\Delta p_R$
$\Delta p$

METHOD OF OPERATING A BURNER AND BURNER CONFIGURATION

CROSS-REFERENCE TO RELATED APPLICATION

This application is a continuation of copending International Application No. PCT/DE99/02713, filed Aug. 31, 1999, which designated the United States.

BACKGROUND OF THE INVENTION

1. Field of the Invention

The invention relates to a method of operating a burner that is supplied with a quantity of a fuel by a fuel supply line. The fuel quantity is set by the degree of opening of a control element as a function of a selected output of the burner. The invention also relates to a corresponding burner configuration.

Various control systems for gas turbine burners are described in the book "Die Gasturbine (The gas turbine)" by J. Kruschik, Springer-Verlag, Vienna 1960, Second Edition, Pages 354 ff. Depending on the field of employment of the gas turbine, quite different configurations for the control systems exist. A common feature of the control systems is that a fuel supply to the burner is controlled, in each case, in accordance with a preselected output of the gas turbine. The control takes place, for example, as a function of rotational speed by a handling of a control element in a fuel supply line with a centrifugal force pendulum. In the example shown in Fig. 359 on Page 356 of Kruschik, the fuel quantity supplied to the burner is controlled as a function of the air pressure generated by the compressor of the gas turbine. In a further example shown in Fig. 361 on Page 358 of Kruschik, the fuel quantity to be burnt is controlled by a supply/return nozzle. Starting on Page 365 of Kruschik, a control system for the fuel supply to an aircraft turbine is described as particularly demanding because, in this case, it is necessary to deal with large temperature and pressure fluctuations in the external air.

In "Dubbel, Taschenbuch für den Maschinenbau (Machinery Handbook)", published by W. Baltz and K. H. K ütner, Springer-Verlag, 1990, 17$^{th}$ Edition, Section X15 6.4, it is stated that control elements for setting a mass flow of a medium cause a pressure drop as a function of the density and the velocity of the medium. From VDI/VDE Guideline 2173, the $k_V$ value (characteristic value of the valve) determined experimentally for each configuration characterizes the through-flow of incompressible media as a volume flow of water (density $\rho_0$) at temperatures between 5 and 30° C. and a pressure drop $\Delta p_{V0}$ of 0.98 bar. Arbitrary pressure drops $\Delta p_V$ and other densities $\rho$ provide the volume flow:

$$\dot{V}_v = k_v \sqrt{\Delta p_v p_0 / (\Delta p_{vo} p)}.$$

The way in which the $k_V$ value depends on the setting parameter is the valve characteristic. For the completely open valve, $k_V$ is referred to the maximum value $k_{VS}$. The value:

$$k_{vs} = \dot{V}_0 \sqrt{\Delta p_{vo} p / (\Delta p_v p_0)},$$

with the maximum through-flow $\dot{V}_0$, is provided by the valve manufacturer, for example.

SUMMARY OF THE INVENTION

It is accordingly an object of the invention to provide a method of operating a burner and burner configuration that overcomes the hereinafore-mentioned disadvantages of the heretofore-known devices and methods of this general type and that provides a method of operating a burner with a supply of fuel based on a preselected output and a corresponding burner configuration.

With the foregoing and other objects in view, there is provided, in accordance with the invention, a method of operating a burner, including the steps of supplying a burner with a quantity of a fuel through a fuel supply line, setting the fuel quantity by a degree of opening of a control element as a function of a selected output of the burner, determining a calorific value of the fuel, and calculating and directly setting the degree of opening using the output and the calorific value of the fuel.

The invention is based on the knowledge that a conventionally employed, iterative control of the fuel quantity supplied as a function of the preselected output is too sluggish relative to suddenly modified operational boundary conditions. In such an iterative control system, the degree of opening is controlled in steps for setting the preselected power. In other control systems, the required output is, for example, converted directly into a setting parameter that fixes the degree of opening by a mechanical system which, as a rule, is very complex. In such systems, there is generally very limited variability with respect to the reaction to modified boundary conditions because any conversion from the preselected power into the degree of opening takes place only by a preset, fixed mechanism.

In accordance with another mode of the invention, the burner of the invention can be a burner for a gas turbine, in particular, a stationary gas turbine, and also, for example, suitable for an internal combustion engine of a vehicle. Fuel for the burner can, for example, be: mineral oil, natural gas, diesel, gasoline, or kerosene.

For the invention, on the other hand, the degree of opening is first calculated based on the output and, then, is set directly. The invention provides the advantage of removing the need to carry out an iterative control. Consequently, there is a significantly faster system reaction. The system, therefore, reacts more rapidly to, for example, external perturbations such as a pump switching operation. An additional advantage is that it is possible to deal in a better and more variable manner with the current operating conditions because the degree of opening is calculated in a manner matched to the respective operating conditions. For example, modifications to the temperature, density, or type of fuel or a variable pressure at the location of the burner can be employed in a simple manner for regulating the fuel quantity to be supplied. Compared with control systems having a direct, mechanical conversion from the preselected output to the degree of opening, the invention provides a substantially increased flexibility with respect to modified boundary conditions.

The calorific value of the fuel is preferably determined and employed in the calculation of the degree of opening. It is preferable for a mixture of at least two materials to be used as the fuel. The calorific value of the fuel is employed in the determination of the fuel quantity required because the calorific value also determines an effective output from the combustion system. Such a determination of the calorific value is of particular advantage when a fuel mixture is used, possibly even with a composition that varies with time. An oil/water mixture is preferably used as the fuel, the energy consumption for any evaporation of the water being determined during the combustion and being employed in the calculation of the degree of opening. Such an oil/water emulsion or dispersion is used to reduce emissions of oxides of nitrogen. The average combustion temperature is reduced by the admixture of water. Part of the energy of the fuel is consumed by the evaporation of the water and does not, therefore, contribute to the desired output.

It is preferable for the density of the fuel to be determined and employed in the calculation of the degree of opening. The density of the fuel contributes to the determination of the mass flow of the fuel through the fuel supply line. The determination of the density of the fuel is of advantage, particularly when a fuel mixture is used.

A pressure loss in the fuel supply line is preferably determined and employed in the calculation of the degree of opening. Such a pressure loss contributes to the determination of the mass flow of the fuel through the fuel supply line so that the pressure loss is taken into account, in an advantageous manner, in the calculation of the degree of opening.

The burner preferably opens into a combustion chamber in which a combustion chamber pressure is present, the combustion chamber pressure being measured and employed in the calculation of the degree of opening.

The pressure in the combustion chamber has an effect on the quantity of fuel entering the combustion chamber. Particularly in the case of a gas turbine, the pressure in its combustion chamber is substantially higher than the ambient pressure because combustion air from a compressor is supplied to the combustion chamber.

For the control element, a through-flow comparison value is preferably determined at which, for the pressure conditions present, there is a fuel mass flow through the control element that leads to the selected output of the burner. The degree of opening is determined by a conventional relationship between the through-flow comparison value and the degree of opening. Such a through-flow comparison value is the $k_V$ value provided by the machinery handbook cited.

The burner is preferably configured for optional operation with at least two different fuels. Preferably, the burner can be operated both as a diffusion burner and as a premixing burner. The burner is preferably configured for operation in a gas turbine, in particular, in a stationary gas turbine. Such a burner can, for example, be operated with both mineral oil and natural gas. Preferably, the burner has a central pilot burner that operates as a diffusion burner, i.e., there is no premixing of combustion air and fuel. The central pilot burner is surrounded by a main burner that operates as a premixing burner, i.e., combustion air and fuel are first mixed and subsequently supplied to the combustion process. The diffusion burner preferably has a supply/return nozzle, i.e., the fuel, in particular, mineral oil, enters the nozzle through a supply duct and part of it emerges from the nozzle opening. The remaining part of the fuel is returned through a return line back into a fuel collecting container. In the configuration, the fuel quantity supplied and the fuel quantity returned can each be set by its own control element. The control of the fuel quantity supplied is very complex for such a system. A flexible setting of the degree of opening, as a function of the respective operating conditions, is of particular advantage in this case.

With the objects of the invention in view, there is also provided a burner configuration, including a fuel supply line, an adjustable burner supplied with a quantity of a fuel through the fuel supply line, a control element in the fuel supply line, the control element having a selectable opening for setting the fuel quantity as a function of a selected output of the burner, and a controller connected to the control element. In the controller, the degree of opening can be determined as a function of the output, the type of the fuel, and a pressure loss in the fuel supply line, and a corresponding signal can be transmitted to the control element such that the degree of opening is set.

The advantages of such a burner configuration follow correspondingly from the above statements on the advantages of the method of operating a burner.

Other features that are considered as characteristic for the invention are set forth in the appended claims.

Although the invention is illustrated and described herein as embodied in a method of operating a burner and burner configuration, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWING

The FIGURE is a flow circuit diagram of a burner configuration and a method of operating a burner configuration according to the invention.

DESCRIPTION OF THE PREFERRED EMBODIMENTS

Referring now to the single FIGURE of the drawing, it is seen, diagrammatically and not to scale, a burner 1 that is disposed in a gas turbine 2. The gas turbine 2 has a compressor 4, a combustion chamber 6, and a turbine 8 connected in series. The burner 1 has a central diffusion burner 3 and a premixing burner 5 that surrounds the diffusion burner 3 in the form of an annular duct. The diffusion burner 3 includes a supply duct 7 and a return line 9. The diffusion burner 3 opens into the combustion chamber 6 through a nozzle opening 11. The premixing burner 5 is supplied through a flow path 13 with compressor air from the compressor 4. Compressor air is also supplied to the diffusion burner 3 (not shown in any more detail here). A fuel supply line 15*a* leads to the premixing burner 5. A fuel supply line 15*b* leads to the diffusion burner 3. A fuel return line 17 follows on from the return line 9. A control element 19*a* is installed in the fuel supply line 15*a* and a control element 19*b* is installed in the fuel supply line 15*b*. A respective degree of opening O for the control elements 19*a*, 19*b* is graphically represented by the pistons 20*a*, 20*b*. A control element 21 is installed in the fuel return line 17. A degree of opening O for the control element 21 is likewise graphically represented by a piston 22. The control element 19*a* is connected to a control device 27 by a line 23*a*, the control element 19*b* is connected to the control device 27 by a line 23*b*, and the control element 21 is connected to the control device 27 by a line 25. In addition, an input line 28 for setting a desired output L for a gas turbine 2, leads into the control device 27. In addition, the control device 27 is connected by a line 29 to a pressure sensor 31 that is disposed in the combustion chamber 6. The fuel supply lines 15*a* and 15*b* are connected to a pump 39. A mixer 37 is connected upstream of the pump 39. The mixer 37 is connected to a water tank 35 and an oil tank 33. In addition, the fuel return line 17 opens into the oil tank 33.

During operation of the gas turbine 2, oil B from the oil tank 33 is pumped into the mixer 37 by the pump 39. In addition, water H from the water tank 35 is fed into the mixer 37. The oil B and the water H mix to form a fuel BH. The fuel BH is supplied to the premixing burner 5 and the diffusion burner 3 by the fuel supply lines 15*a* and 15*b*. The fuel BH then burns in the combustion chamber 6. The resulting hot exhaust gas drives the turbine 8. A larger or smaller quantity of fuel BH must be supplied, depending on the desired output of the turbine 8. It is then often also desirable to set a variable content of water H in the fuel BH. The variable water content alters both the calorific value of the fuel BH and the energy consumption for any evaporation of the water H. The density of the fuel BH also changes. These variable parameters influence an effective output during the combustion so that the quantity of fuel BH supplied to achieve the desired output L must be correspondingly regulated. In addition, sudden pressure drops, for example, can make a very rapid regulation of the fuel quantity supplied necessary. In the configuration shown, these requirements are met by supplying the desired output L to the control device 27, where the respective degree of opening O of the control elements 19*a*, 19*b*, and 21 is calculated from the physical boundary conditions. Therefore, there is no subsequent slow, iterative regulation of the fuel quantity supplied. The type and composition of the fuel BH contribute to the calculation of the degree of opening O so that it is possible to deal with a variable composition of the fuel BH. Specifically, the calculation of the degrees of opening O takes place in the following example.

The calorific valve $HW_{BH}$ of the fuel BH is first determined from:

the mass flow $\dot{m}_H$ and the calorific value $HW_H$ of the water H; and the mass flow $\dot{m}_B$ and the calorific value $HW_B$ of the heating oil B, using the following equation:

$$HW_{BH} = \frac{\dot{m}_H \cdot HW_H + \dot{m}_B \cdot HW_B}{\dot{m}_H + \dot{m}_B}$$

The energy consumption for the evaporation of the water H is taken into account by a negative calorific value $HW_H$ for the water H.

In a second step, the density $D_{BH}$ of the fuel is determined from the density $D_B$ of the oil and the density $D_H$ of the water using the following equation:

$$D_{BH} = \frac{(\dot{m}_H + \dot{m}_B) \cdot D_B \cdot D_H}{\dot{m}_H \cdot D_B + \dot{m}_B \cdot D_H}$$

In addition, the pressure loss $\Delta p_D$ in the diffusion burner 3 is determined from a characteristic value K that is specific to the diffusion burner 3 and depends on the entering mass flow $\dot{m}_{VL}$ and the return mass flow $\dot{m}_{RL}$ using the following equation:

$$\Delta p_D = K\left(\frac{\dot{m}_{VL}}{\dot{m}_{RL}}\right) \cdot \dot{m}_{VL}^2 \cdot \frac{1}{D_{BH}}$$

The pipework pressure loss $\Delta p_R$ in the fuel supply lines 15*a* and 15*b* is determined, using a $k_V$ value $k_{VR}$ specific to these lines, using the following equation:

$$\Delta p_R = \dot{m}_{VL}^2 \cdot \frac{1}{D_{BH}} \cdot \frac{1}{k_{VR}^2}$$

Using the combustion chamber pressure pB present in the combustion chamber 6, the pressure pS that has to be set downstream of the control elements 19*a*, 19*b* is now determined from:

$$pS = pB + \Delta p_D + \Delta p_R.$$

The $k_V$ value for the control elements 19*a*, 19*b* is now given, using the pressure pP downstream of the pump 39 as:

$$k_v = \frac{\dot{m}_{VL}}{\sqrt{D_{BH} \cdot (pP - pS)}}.$$

The desired degree of opening O is finally determined from the relationship between the $k_V$ value and the degree of opening O. The respective degrees of opening O at the control elements 19*a*, 19*b* are set by signals SA, SB. A signal SC for the control element 21 in the return line 17 occurs in an analogous manner, precisely like the calculation of the signals SA and SB.

We claim:

1. A method of operating a burner, which comprises:

supplying a burner with a quantity of a fuel through a fuel supply line;

setting the fuel quantity by a degree of opening of a control element as a function of a selected output of the burner;

determining a calorific value of the fuel;

determining a density of the fuel; and calculating and directly setting the degree of opening using the output, the calorific value of the fuel and the density of the fuel.

2. The method according to claim 1, which further comprises using a mixture of at least two materials as the fuel.

3. The method according to claim 2, which further comprises:

using an oil and water mixture as the fuel; and determining an energy consumption for any evaporation of the water during the combustion and employing the energy consumption in the calculation of the degree of opening.

4. The method according to claim 1, which further comprises determining a pressure loss in the fuel supply line and employing the pressure loss in the calculation of the degree of opening.

5. The method according to claim 1, which further comprises measuring a combustion chamber pressure in a combustion chamber open to the burner and employing the combustion chamber pressure in the calculation of the degree of opening.

6. The method according to claim 1, which further comprises configuring the burner for optional operation with at least two different fuels.

7. The method according to claim 6, which further comprises operating the burner both as a diffusion burner and as a premixing burner.

8. The method according to claim 1, which further comprises configuring the burner for operation in a gas turbine.

9. The method according to claim 1, which further comprises configuring the burner for operation in a stationary gas turbine.

* * * * *